United States Patent [19]

Coble

[11] 4,125,306

[45] Nov. 14, 1978

[54] SPIKED LOW-VOLTAGE AGING OF CATHODE-RAY TUBES

[75] Inventor: John T. Coble, Marion, Ind.

[73] Assignee: RCA Corporation, New York, N.Y.

[21] Appl. No.: 852,449

[22] Filed: Nov. 17, 1977

[51] Int. Cl.[2] ..... H01J 9/44

[52] U.S. Cl. ..... 316/1

[58] Field of Search ..... 316/1, 17, 26, 27, 32, 316/28

[56] References Cited

U.S. PATENT DOCUMENTS

| | | | |
|---|---|---|---|
| 3,321,263 | 5/1967 | O'Fallon | 316/18 |
| 3,357,766 | 12/1967 | Conger, Jr. | 316/1 |
| 3,966,287 | 6/1976 | Liller | 316/1 |

*Primary Examiner*—Richard B. Lazarus

*Attorney, Agent, or Firm*—E. M. Whitacre; G. H. Bruestle; L. Greenspan

[57] ABSTRACT

During low-voltage aging of a completely assembled cathode-ray tube, at least three voltage spikes at least three minutes apart are applied to the heater. Each spike has a voltage peak higher than the constant voltage applied to the heater during low voltage aging, and lasts for up to 120 seconds. This results in higher average emission levels and a reduced tendency of the emission levels to slump during emission testing of cathodes so processed.

4 Claims, 5 Drawing Figures

Fig. 1.
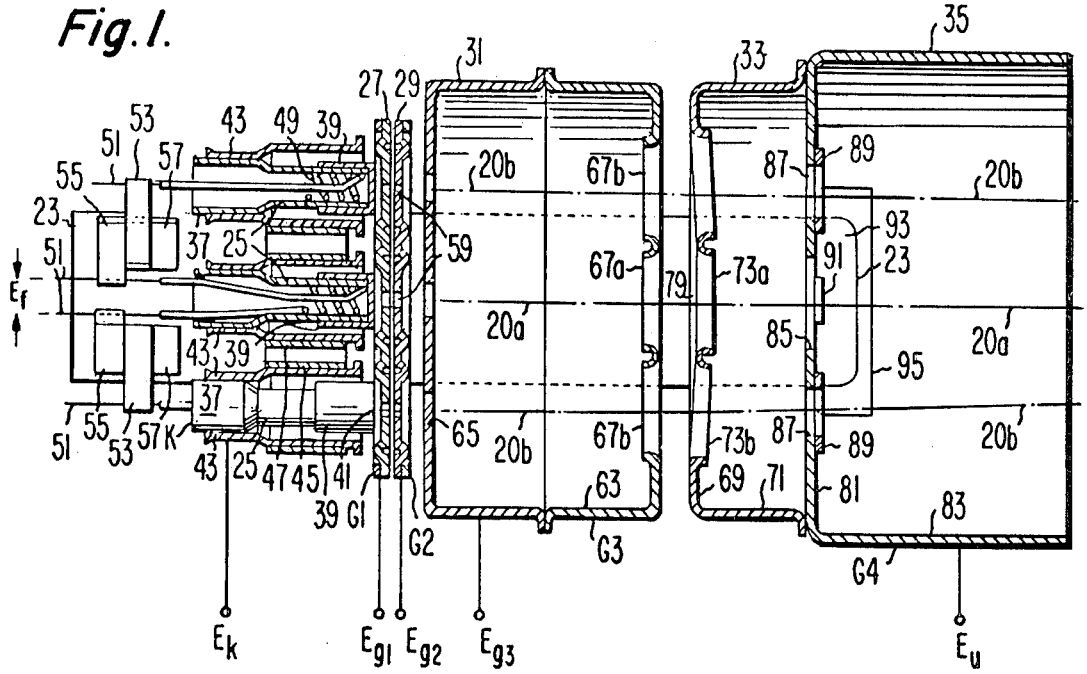
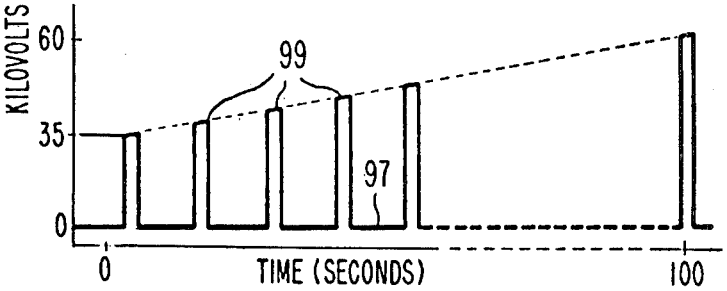
Fig. 2.
Fig. 3.
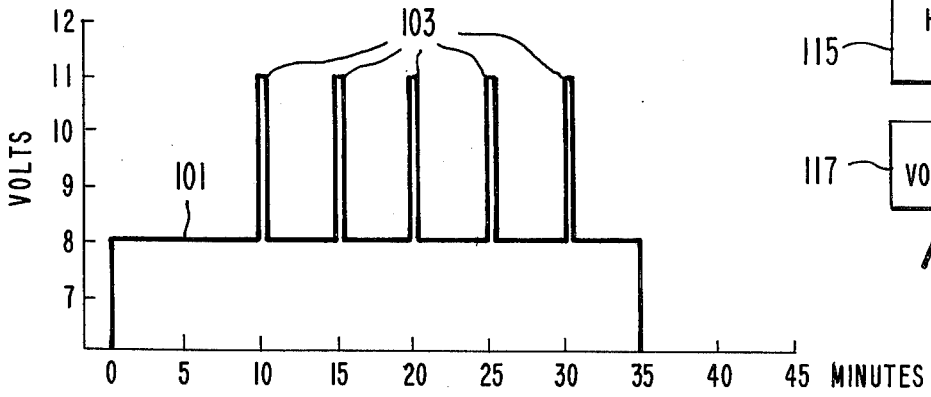
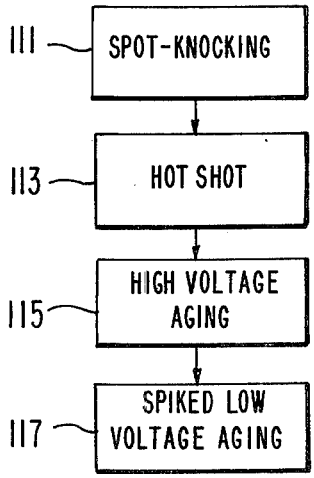
Fig. 5.

SPIKED LOW-VOLTAGE AGING OF CATHODE-RAY TUBES

BACKGROUND OF THE INVENTION

This invention relates to a novel method for electrically processing completely-assembled cathode-ray tubes having electron guns with indirectly-heated oxide cathodes. One or more guns may be installed in each cathode-ray tube.

In the manufacture of cathode-ray tubes having electron guns with indirectly-heated oxide cathodes, it is the practice to process the tubes after they have been completely assembled, exhausted of gases and sealed, so that the tubes become operative. The tubes' operations are stabilized and the operating lives are lengthened. For this processing, each gun in the tube is usually subjected is succession to the steps of "spot knocking," "hot shot," "high-voltage aging" and "low-voltage aging."

In one form of the "spot-knocking" step, the cathode, the heater and the low-voltage electrodes G1, G2 and G3 are grounded, and a pulsed positive voltage which peaks at about 200% of the normal ultor voltage is applied to the high-voltage electrode G4 and to the anode (the internal conductive funnel coating) of the tube for about 2 minutes to burn off loose particles which may reside between the electrodes in the gun.

In one form of the hot-shot step, the cathode is activated by heating it to an abnormally high temperature, as by applying about 10 to 12 volts across the cathode heater (where 6 to 7 volts are normally applied) for about 2 minutes, with all of the electrodes and the anode floating electrically. The initial portion of the hot-shot step may also be used to convert the cathode coating from carbonates to oxides. Converting the cathode coatings is usually done when the tubes are being exhausted of gases prior to sealing.

In one form of the high-voltage aging step, which usually lasts for about 3 to 60 minutes, the cathode is emitting, various combinations of constant voltages including ground potential are applied to the G1, G2 and G3 electrodes, and a high voltage, substantially higher than normal operating ultor voltage, is applied to the high-voltage electrode G4. The high-voltage aging step allows time-related defects to manifest themselves and, in most cases, cure themselves. The high-voltage aging step is optional and is omitted from the processing of many tubes.

In one form of the low-voltage aging step, sometimes called the cathode-aging step, which usually lasts for about 30 to 90 minutes, the cathode is emitting, various combinations of constant positive voltages are applied to the control electrode G1, the screen electrode G2 and the focus electrode G3, and the high-voltage-electrode G4 is floating electrically. The low-voltage aging step permits the emission from the cathode to stabilize and the various electrodes to outgas due to bombardment by electrons from the cathode. Although low-voltage aging achieves these objects in most tubes, nevertheless, after low-voltage aging a significant portion of tubes exhibit (a) too low an initial cathode-emission level and/or (b) a drop of slump in cathode emission level from its initial level after only a short period of use, or (c) when, after a holding period or shelf life, a portion of the tubes exhibit the characteristics noted in (a) and (b). The conditions (a), (b) and (c) are more prone of tubes whose cathode coatings are converted during the hot-shot step instead of during the period when the envelope was exhausted of gases prior to sealing.

SUMMARY OF THE INVENTION

In the novel method for processing a completely-assembled and exhausted cathode-ray tube, at least three voltage spikes are applied periodically to the cathode heater during the low voltage aging step. The spikes are at least three minutes apart, last for up to 120 seconds and have a peak voltage that is higher than the voltage that is applied to the cathode heater during the low voltage aging step.

By applying the voltage spikes to the heater according to the novel method, one or more of the following advantages are realized: First, the average initial cathode emission level is higher and the dispersion of emission levels is more compact. Second, there is a reduction in the proportion of cathodes whose emission drops or slumps from its initial value. Third, a lower heater voltage can be used during low voltage aging. Fourth, all cathode coatings can be both converted and activated during hot shot, thereby eliminating the need to convert the cathode coating during the period when the tube is being exhausted of gases. Overall, the novel method permits an improvement in yield and/or a reduction in cost of finished cathode-ray tubes.

BRIEF DESCRIPTION OF THE DRAWINGS

FIG. 1 is a sectional elevational view of an electron-gun mount upon which the novel method is exemplified.

FIG. 2 is a graph illustrating the pulse train employed during the spot-knocking step in the example herein.

FIG. 3 is a graph illustrating graphically the voltages applied to the heater during the low-voltage-aging step of the invention.

FIG. 5 is a process flow chart illustrating generally the steps, including the novel spiked cathode-aging step, employed in processing finished cathode-ray tubes according to the invention.

DETAILED DESCRIPTION OF THE PREFERRED EMBODIMENTS

Figure 4:
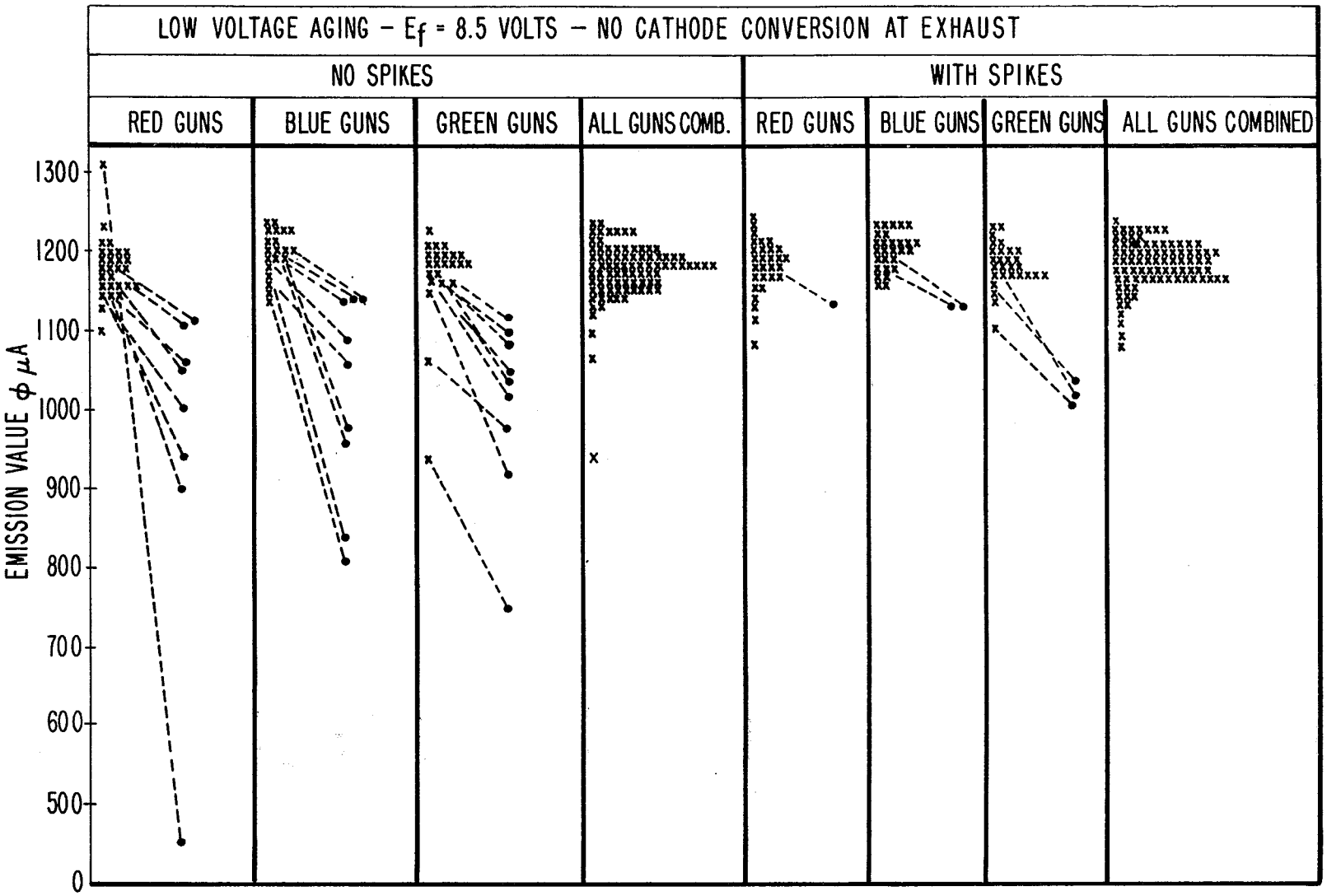
FIG. 4 is a graph of compiled data comparing the initial cathode-emission levels and emission slumps during emission tests conducted after aging has been completed for cathode-ray tubes processed by the novel method with similar tubes processed by a comparable prior method.

This invention may be applied to any electron gun having a cathode and four or more electrodes which are biased independently of one another. One family of such electron guns is referred to as bipotential guns. There may be a single gun or a plurality of guns in the gun mount of the cathode-ray tube. Where there is more than one gun in the mount, the guns may be in any geometric arrangement. Where there are three guns, as in a color television picture tube for example, the guns may be arranged in a delta array, or in an in-line array, or other array.

The invention will now be exemplified for the tube described in FIGS. 1 and 3 to 8 of U.S. Pat. No. 3,772,554 to Richard H. Hughes. This tube employs a mount assembly 21 comprising three bipotential guns in in-line array shown in longitudinal section in FIG. 1 herein. Each mount assembly comprises two glass support rods 23 on which the various electrodes of the guns are mounted. These electrodes include three equally-spaced co-planar cathodes 25, one for each beam, a control electrode 27, a screen electrode 29, a focusing electrode 31, a high-voltage electrode 33, and a shield cup 35, spaced along the glass rods 23 in the order named.

Each cathode 25 (also referred to as K) comprises a cathode sleeve 37, closed at the forward end by a cap 39 having an end coating 41 of electron emissive material and a cathode support tube 43. The tubes 43 are supported on the rods 23 by four straps 45 and 47. Each cathode 25 is indirectly heated by a heater 49 positioned within the sleeve 37 and having legs 51 welded to heater straps 53 and 55 mounted by studs 57 on the rods 23. The control and screen electrodes 27 and 29 (also referred to as G1 and G2 respectively) are two closely-spaced (about 9 mils) flat plates having three pairs of small (about 25 mils) aligned apertures 59 centered with the cathode coatings 41 to initiate three equally-spaced co-planar beam paths including a middle path 20*a* and two side paths 20*b* extending toward the screen of the tube (not shown). The initial portions of the side paths 20*b* are substantially parallel and about 200 mils from the middle path 20*a*.

The focus electrode 31 (also referred to as G3) comprises first and second cup-shaped members 61 and 63, respectively, joined together at their open ends. The first cup-shaped member 61 has three medium-sized (about 60 mils diameter) first G3 apertures 65 close to the grid electrode 29 and aligned respectively with the three beam paths 20*a* and 20*b*. The second cup-shaped member 63 has 3 second G3 apertures including a middle second G3 aperture 67*a* and two side second G3 apertures 67*b*, each about 160 mils in diameter, also aligned with the three beam paths.

The high-voltage electrode 33 (also referred to as G4) is also cup-shaped and comprises a plate 69 positioned close (about 60 mils) to the focus electrode 31, and a flange 71 extending forward toward the tube screen. The base portion 69 is formed with a middle G4 aperture 73*a* and two side G4 apertures 73*b*, which are preferably slightly larger (about 172 mils in diameter) than the adjacent G3 apertures 67*a* and 67*b* of the electrode 31. The middle G4 aperture 73*a* is aligned with the adjacent middle second G3 aperture 67*a* and the middle beam path 20*a*. The two side G4 apertures 73*b* are slightly offset outwardly with respect to the corresponding side second G3 apertures 67*b*. In the example shown, the offset of each side G4 aperture 73*b* may be about 6 mils. The plate 69 is concave with respect to the G3 electrode 31 as shown at 79.

The shield cup 35 comprises a base portion 81, attached to the open end of the flange 71 of the G4 electrode 33, and a tubular wall 83 surrounds the three beam paths 20*a* and 20*b*. The base portion 81 is formed with a large middle shield aperture 85 (about 172 mils) and two smaller side shield apertures 87, about 100 mils in diameter, aligned respectively with the three beam paths 20*a* and 20*b*. Two shield rings 89 of high magnetic permeability are attached to the base 81, with each ring concentrically surrounding one of the outer shield apertures 87. The shield rings 89 may have an outer diameter of about 150 mils, an inner diameter of about 100 mils, and a thickness of about 10 mils. Two small discs 91 of magnetic material are mounted on each side of the middle beam path 20*a*. The discs 91 may be rings having an outer diameter of about 80 mils, an inner diameter of about 30 mils, and a thickness of about 10 mils. The mount assembly is supported in the neck of a cathode-ray tube at one end by the leads (not shown) from the various electrodes, and at the other end by metal bulb spacers (not shown) which also connect the G4 electrode 33 to the usual conducting funnel coating on the inner wall of the tube.

Cathode-ray tubes may be processed according to the invention in a succession of stations having equipments which can apply, for the various processing steps, programs of voltages to the cathode and the various electrodes of each electron gun in the tube. The tube may be transported by hand or on a conveyer from station to station as is known in the art. One suitable conveyor is described in U.S. Pat. No. 3,698,786 to Edward A. Gronka and another is described in U.S. Pat. No. 2,917,357 to T. E. Nash et al.

The novel method will be exemplified now on the above-described tube transported by hand. At each station, the tube is placed in a holder therefor, and a socket is connected to the base pins of the tube. Each gun is subjected in the following sequence of steps in which the following nomenclature is used:

$E_f$ is the voltage applied across the cathode heater 49,
$E_k$ is the voltage applied to the cathode K,
$E_{g1}$ is the voltage applied to the control electrode G1,
$E_{g2}$ is the voltage applied to the screen electrode G2,
$E_{g3}$ is the voltage applied to the focus electrode G3,
$E_u$ is the voltage applied to the high-voltage electrode G4 through the connection to the conductive internal funnel coating or anode.

Step 1 — Spotnocking — The cathode, the heater and the G1, G2 and G3 electrodes are electrically grounded. The G4 electrode is connected to a source which supplies the train of pulses 99 of positive voltage $E_u$ as shown on the curve 97 in FIG. 2 to these elements. The pulses rise from ground potential initially to $E_u$ = plus 35 ± 5 kilovolts, increasing linearly to $E_u$ = plus 60 ± 5 kilovolts in 90 to 120 seconds. Each pulse is comprised of ac voltage peaking at the value shown and having a frequency of 60 hertz. The positive portion of the ac voltage is clamped to ground potential. The duration of the pulses may be in the range of 0.1 to 0.2 second (6 to 12 cycles), and the spacing of the pulses may be in the range of 0.5 to 1.0 second.

Step 2 — Cathode Preheating — $E_f$ = 9.5 ± 0.5 volts for 40 to 80 seconds. All other elements are floating.

Step 3 — Hotshot — $E_f$ = 11.0 ± 1.0 volts for 90 to 120 seconds. All other gun elements are electrically floating.

Step 4 — Cathode Stabilizing — $E_f$ = 8.5 ± 0.9 volts for at least 60 seconds. All other gun elements are electrically floating.

Step 5 — High Voltage Aging — $E_f$ = 8.5 ± 0.9 volts, $E_k = E_{g1} = E_{g2} = E_{g3} = 0$ (ground potential), and $E_u$ = 32 ± 4 kilovolts for about 20 ± 4 minutes.

Step 6 — Low Voltage Aging — $E_f$ = 8.5 ± 0.9 volts, $E_k = 0$, $E_{g1} = 0$, $E_{g2}$ = 350 ± 50 volts dc, $E_{g3}$ = 0 and $E_u$ is floating for at least 25 minutes. FIG. 3 shows the voltage $E_f$ applied to the cathode heater during the entire 35 minutes of low-voltage aging. In addition to the constant voltage 101 $E_f$ = 8.5 ± 0.9 volts, there are superimposed thereon five voltage spikes 103 of 30 ± 10 seconds, each of which peaks at about 11.5 ± 1.0 volts. These spikes are applied preferably at 5-minute intervals during the latter part of the low-voltage aging step. The low-voltage aging step can be lengthened to about 120 minutes by extending the initial constant voltage 101 by the desired amount of time.

Step 7 — Cooling — Cool the tube for at least 2 minutes with all elements floating electrically.

Step 8 — Post-Age Spotknocking — Repeat step 1 except apply pulses which peak at $E_u = 58 \pm 5$ kilovolts for about 3 minutes.

Step 9 — Final Cathode Aging — Repeat step 6 for $5.0 \pm 0.5$ minutes.

Step 10 — Cooling — Cool the tube with all elements floating electrically.

FIG. 4 shows the frequency distribution of the initial cathode emission $\phi$ in microamperes $\mu$a for cathodes in three-gun color picture tubes wherein one group was processed in a similar prior aging process with no voltage spikes (no spikes) during aging and the other group was processed by the novel spiked aging process with voltage spikes (with spikes) during aging as described above. Each "X" indicates the initial cathode emission of a particular cathode in a tube. It will be noticed that the cathodes processed "with spikes" are bunched closer together and are at a higher average emission level than cathodes processed "no spikes." Also demonstrated in FIG. 4 is the reduced tendency for the emission to slump during emission testing for cathodes prepared by the novel method. As shown by the dotted lines in FIG. 4, fewer cathodes processed by the novel method "with spikes" slump during emission testing, and those that slump do so to relatively higher values than cathodes processed "no spikes" by the prior aging process. The dotted lines identify specific cathodes that slumped during a 30-second period during emission testing. The terminus point shows the value to which the cathode slumped. Cathodes with less than 50 $\mu$a change in cathode emission are not plotted.

GENERAL CONSIDERATIONS

FIG. 5 shows the general sequence of steps for processing completely-assembled cathode-ray tubes by the novel method. These steps, which are exemplified above, are spot-knocking shown by the box 111, hot-shot shown by the box 113, high-voltage aging shown by the box 115 and varying low-voltage aging shown by the box 117. It may be desirable to repeat some of these steps as shown by steps 8 and 9 of the example. Also, it may be desirable to add some steps as shown by steps 2, 4, 7 and 10 of the example. The first three steps shown by the boxes 111, 113, and 115 may be by any of the programs known in the prior art.

The last step shown by the box 117 differs from the prior methods in that both a spiked positive voltage and a constant positive voltage are applied to the cathode heater. Prior methods apply only a constant voltage to the heater. The voltage spikes peak above the constant positive voltage, usually at least at or above 9.0 volts and preferably in the range of 9.0 to 12.0 volts. It is preferred to space the spikes 3 to 9 minutes apart. Three to nine spikes have been found to be practical. The spikes may be spaced apart by time intervals which permit the cathode to cool sufficiently to provide thermal cycling. Three-to-seven-minute time intervals have been found to be practical.

While the nature of the novel method is not completely understood, it is believed that the effect of the novel spiked low-voltage aging step shown in the box 117 may be one of better outgassing of the cathode coating or decreasing the level of resorbed gases, which have outgassed from other structures in the tube during electrical processing. Most of the liberated gases are sorbed by the getter material in the tube, but a small portion reacts with the cathode coating 41, causing a reduction in cathode emission, which is believed also to be a cause of cathode slumping. Continued low-voltage aging for at least 10 minutes by the novel method restores the emission to desired levels, and avoids a potential source of slumping during subsequent testing and/or operation.

I claim:

1. A method for processing a sealed cathode-ray tube comprising an evacuated envelope and, positioned therein, an electron gun including a cathode and a heater for said cathode, said method including the steps of:

(a) spot knocking
(b) hot shot and
(c) low-voltage aging characterized in that, during low voltage aging, at least three voltage spikes are applied to said heater, said voltage spikes being at least three minutes apart, each voltage spike having a peak of at least 9.0 volts and lasting for a time period of up to 120 seconds and having a voltage peak that is higher than the voltage applied to said heater during low-voltage aging.

2. The method defined in claim 1 wherein each voltage spike has a peak voltage in the range of 9.0 to 12.0 volts.

3. The method defined in claim 1 wherein between 3 and 9 spikes are applied to said heater.

4. The method defined in claim 1 wherein 5 spikes spaced about 5 minutes apart are applied to said heater.

* * * * *